United States Patent [19]

Bruner

[11] Patent Number: 4,481,931

[45] Date of Patent: Nov. 13, 1984

[54] FUEL MIXING APPARATUS

[76] Inventor: Frank D. Bruner, 10012 Emmet, Omaha, Nebr. 68134

[21] Appl. No.: 47,343

[22] Filed: Jun. 8, 1979

[51] Int. Cl.[3] ..... F02M 37/20; F02M 31/16

[52] U.S. Cl. ..... 123/557; 123/514; 123/549; 137/590

[58] Field of Search ..... 123/136, 122 H, 122 E, 123/139 AU, 557, 514, 549, 516; 137/590, 592, 604; 165/40

[56] References Cited

U.S. PATENT DOCUMENTS

| | | | |
|---|---|---|---|
| 1,384,512 | 7/1921 | Buchi | 123/122 E |
| 1,623,074 | 4/1927 | Tartrais | 123/122 E |
| 1,923,224 | 8/1933 | Moise | 123/136 |
| 2,881,828 | 4/1959 | McGinnis | 123/122 E |
| 3,658,041 | 4/1972 | Lowrey | 123/122 E |
| 3,768,454 | 10/1973 | Markland | 123/122 E |
| 3,768,730 | 10/1973 | Campbell | 123/122 E |
| 4,279,232 | 7/1981 | Schuster et al. | 123/514 |

*Primary Examiner*—Charles J. Myhre
*Assistant Examiner*—Carl Stuart Miller
*Attorney, Agent, or Firm*—Robert A. Ostmann

[57] ABSTRACT

The fuel system of a diesel powered vehicle is kept free of wax blockages during cold weather by a mixing unit which is submerged in the fuel tank and furnishes to the fuel pump a waxing resistant supply stream comprising a warm fraction derived from the excess fuel by-passed by the engine injectors and a cold fraction derived from the stored fuel in the tank. The unit delivers to the pump a controlled portion of the excess fuel whose size depends upon the rate of flow, so that the supply stream contains substantially all of the excess fuel when the engine is operating at full throttle, but contains only a selected fraction of the excess fuel when the engine is idling. The balance of the excess fuel available at idle is discharged into the tank. The mixer requires no thermostatic element or other moving parts, can be installed without structural modification of the tank, and keeps the system free of wax blockages without overheating the fuel oil. An improved fuel system incorporating the mixer embodies a heat exchanger for the excess fuel returned to the mixer, and a selector valve which is used to terminate the heat exchanging and mixing functions in the warmer seasons of the year.

20 Claims, 10 Drawing Figures

Fig. 1
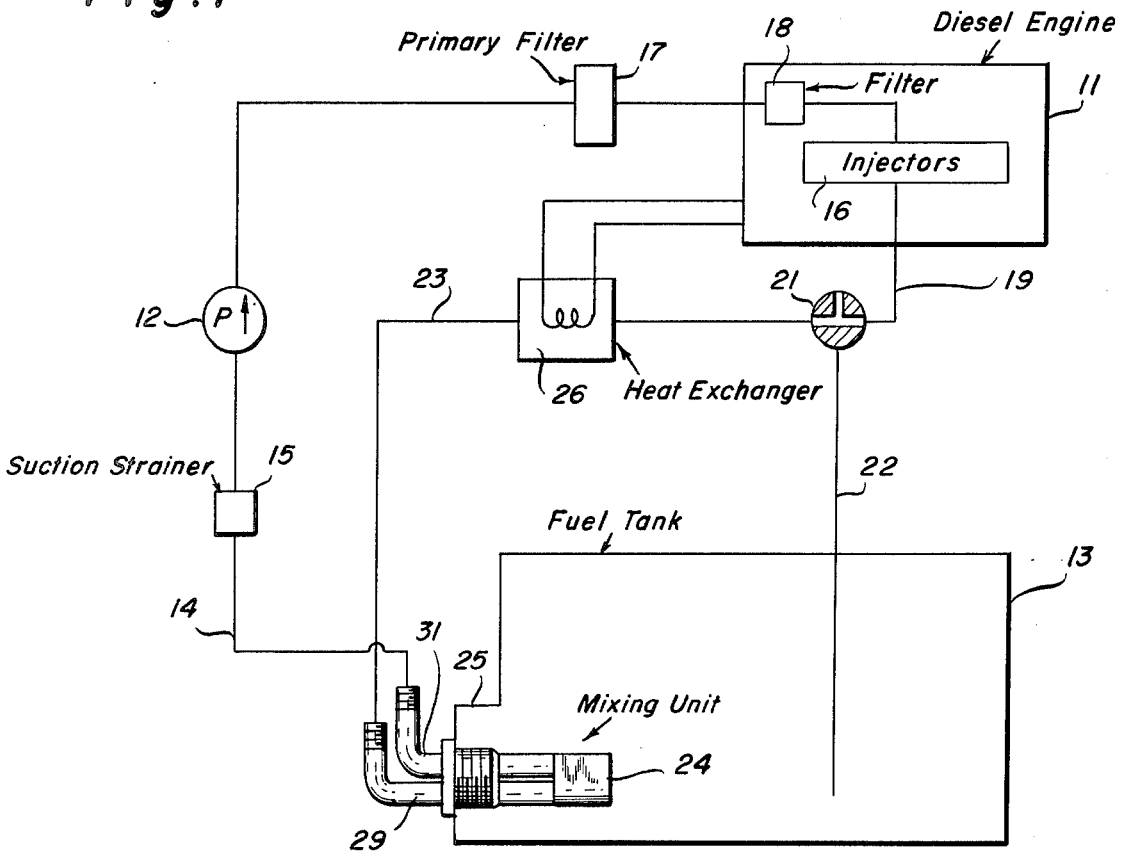
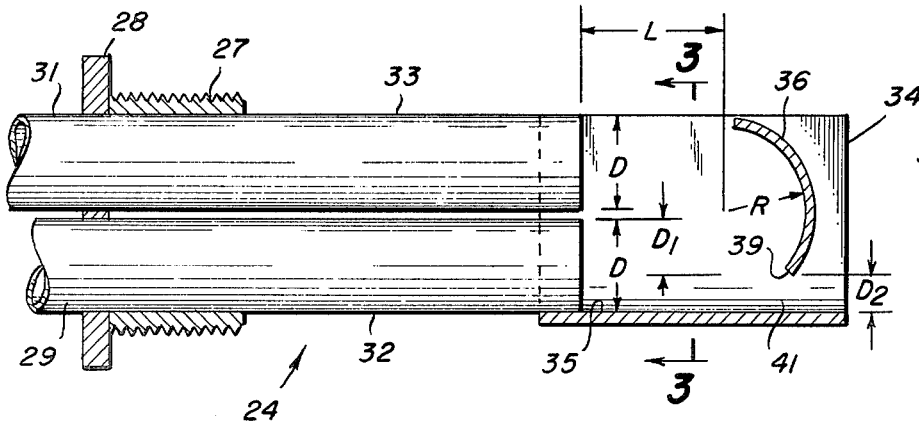
Fig. 2
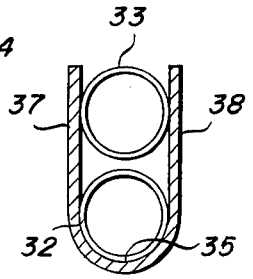
Fig. 3

FUEL MIXING APPARATUS

BACKGROUND OF THE INVENTION

Diesel power plants for locomotives and trucks include a fuel system which supplies the engine injectors with fuel at a rate which always exceeds the demands of the engine. The excess fuel, whose quantity varies from a minimum at full throttle to a maximum at idle, is returned to the fuel tank, where it is comingled with the stored fuel, and subsequently is redelivered to the engine. The excess fuel usually is heated by the engine, particularly in the case of EMD locomotives; therefore, recirculation of this fuel tends to keep the entire fuel system warm.

The transportation industry normally is supplied with No. 2 grade diesel fuel, which contains wax constituents. The temperature at which this wax crystallizes, called the cloud point, varies between 5° F. and 20° F., depending upon the type of crude oil and the process used to refine it. In view of its relatively high cloud point, the No. 2 grade fuel can cause serious operating difficulties in the winter. If tank temperature decreases below the cloud point, the wax crystals which form in the fuel frequently clog the filters, which are located between the pump and the injectors, and thus interrupt the supply of fuel to the engine. As a result, the engine will shut down, thereby necessitating servicing, or even major repairs if a freeze-up occurs, and causing transportation delays.

Various solutions to the wax-up problem have been proposed. One, of course, is to use a better grade of fuel, such as dewaxed No. 2 or a mixture of No. 2 and No. 1 grade fuels. This solution, however, is very expensive, intolerably so in the case of a railroad. Another solution, and one which has been used by U.S. railroads, is to employ electric heaters in the wayside storage tanks, but this too is quite expensive, and it is not a complete answer at times when ambient temperatures remain below 0° F. for extended periods or when the frequency at which locomotive fueling occurs is so high that there is insufficient time for the fuel to be warmed. A more attractive solution employed by the railroad industry consists in adding to the fuel system a heat exchanger which uses engine coolant to heat the fuel flowing from the pump to the filters. If the capacity of this heat exchanger is sufficient, this solution is acceptable for many of the operating conditions encountered in the winter. However, it is not effective in cases where ambient, and consequently tank, temperature remains well below the cloud point for long periods of time. Under these extreme conditions, which were encountered in the winter of 1978–1979, the filters still can become clogged with wax when the engine is idling and little heat is made available to the heat exchanger, unless, of course, idle speed is increased and fuel is wasted. Moreover, even when the engine is running at higher speeds and generates sufficient heat to prevent plugging of the filters, wax crystals can, and commonly, do, clog the suction line leading from the tank to the inlet of the fuel pump. The reason for this will be evident when it is recalled that diesel fuel is a relatively good heat insulator. Because of this characteristic, there is a large temperature gradient through the fuel tank, and wax crystals will develop in those regions remote from the one to which the warm excess fuel is returned.

It has also been proposed to provide in the fuel tank a confined zone or well in which the warm fuel returned from the engine is combined with stored fuel to create a heated mixture which is supplied to the suction line of the fuel pump. The admission of return fuel to the well is controlled by a temperature responsive valve which senses the temperature of the output flow and serves either as a switch which directs return flow to the well or to a remote region of the tank, or as a flow divider which splits the return flow between these two destinations. A scheme of this kind may be effective to prevent detrimental waxing under idle conditions, but, since it does not insure that any particular fraction of the returning fuel is included in the output mixture, its effectiveness during full throttle operation, when the volume of the returning fuel is relatively small, is questionable. Furthermore, the scheme is considered unattractive because it requires use of a thermostatic control, which sometimes is unreliable and always requires maintenance. In fact, the poor performance record of such elements is so well known that at least one locomotive supplier recommends routine replacement of these parts every two years.

SUMMARY OF THE INVENTION

The object of this invention is to provide a simple, economical and essentially maintenance-free scheme for preventing waxing problems in the fuel systems of diesel power plants. According to the invention, the heart of the improved scheme is a fuel mixing unit which delivers to the suction line a mixture containing a controlled portion of the return fuel whose magnitude depends upon the rate of flow of the return fuel. In particular, the new mixer directs substantially all of the return fuel to the suction line when the engine is operating at full throttle and the flow rate is low, but delivers only a selected fraction of the return fuel to that line when the engine is idling and the flow rate is relatively high. This kind of mixer is capable of providing a mixture warm enough to preclude wax blockages anywhere in the system under all throttle settings, while, at the same time, insuring against overheating of the fuel. Moreover, the unit can be constructed easily using only stationary, rugged components, and it can be installed in the fuel tank simply and without requiring any structural modifications.

Although the improved mixing unit may be used in an otherwise conventional fuel system, it is recommended that two other changes also be incorporated. First, the heat exchanger should be repiped so that it heats the return fuel rather than the fuel entering the filters. This change insures that wax blockage of the suction line will not occur at extremely low temperatures, even in the case of power plants, such as those used on GE locomotives, where the excess fuel is not heated substantially as it passes through the piping on the engine. In addition, this change will prevent overheating of the fuel, and shellacking of the injectors, in the event unseasonably warm temperatures are encountered. Second, it is suggested that the system include two return paths through which excess fuel may be selectively delivered to the tank, one path including the heat exchanger and the mixing unit, and the other being the usual direct path to tank. Selection between these paths is controlled by a manually operated valve which is set in the fall and again in the spring to accommodate the temperatures characteristic of the upcoming season. This twice-a-year manipulation of the selector valve is sufficient because the mixing unit gives acceptable results at fuel tank temperatures between −30° F. and 60° F.

BRIEF DESCRIPTION OF THE DRAWINGS

Several embodiments of the invention are described herein with reference to the accompanying drawings, in which;

FIG. 1 is a schematic representation of the fuel system of an EMD locomotive incorporating the invention.

FIG. 2 is an axial sectional view of the preferred fuel mixing unit.

FIG. 3 is a sectional view taken on line 3—3 of FIG. 2.

DETAILED DESCRIPTION OF ILLUSTRATED EMBODIMENTS

Figure 4:
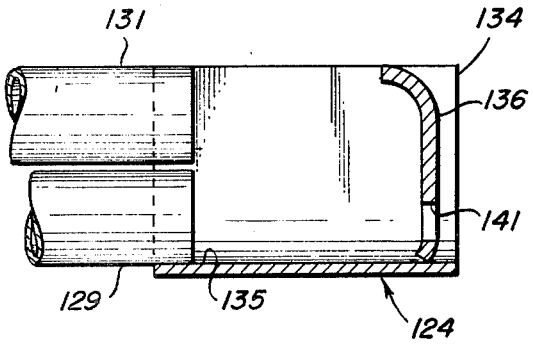
FIGS. 4–8 are axial sectional views of alternative fuel mixing units.

As shown in FIG. 1, the invention is incorporated in the fuel system of the diesel engine 11 of a typical EMD locomotive. The system comprises a fuel pump 12 which is arranged to draw fuel from tank 13 through a suction line 14 containing a strainer 15 and to deliver the fuel under pressure to the injectors 16 via primary filter 17 and engine mounted filter 18. The output of pump 12 always exceeds the fuel demand of engine 11, so the system includes a return line 19 to which the excess fuel is by-passed by injectors 16. Return line 19 is connected to a manually operated valve 21 which serves selectively to convey the excess fuel directly to tank 13 via the usual return pipe 22, or to direct that fuel to a separate flow path 23 which leads to a fuel mixing unit 24 screwed into one of the tapped ports of the drain manifold 25 of tank 13. This second flow path 23 contains a heat exchanger 26, wherein the fuel is heated by engine coolant. The heat exchanger may be the same as the one used before to warm the fuel flowing from pump 12 to filter 17, but a smaller heat exchanger will suffice.

Referring to FIGS. 2 and 3, the preferred fuel mixing unit 24 comprises a mounting sleeve 27 which is sized and threaded to fit a tapped drain port of manifold 25, a circular cover plate 28, and a pair of pipes 29 and 31 having adjacent, parallel portions 32 and 33, respectfully, which extend through plate 28 and sleeve 27. The pipes as welded to cover plate 28 and the latter is welded to sleeve 27 so that the drain port is effectively sealed when unit 24 is in place. The outer ends of pipes 29 and 31 are threaded for connection with the pipe forming the terminal portion of return path 23 and with the pump suction line 14, respectively. The inner ends of pipes 29 and 321 are partially enveloped by a U-shaped shroud 34, which is attached by welding and whose bight 35 lies along return pipe 29. The shroud contains a curved deflector plate 36 which extends between, and is welded to, its side walls 37 and 38 and which is positioned and shaped to direct to the mouth of pipe 31 return fuel which issues from pipe 29. In addition, the lower edge of 39 of plate 36, as view in FIG. 2, coacts with the bight 35 of shroud 34 to define an orifice 41 through which return fuel issuing from pipe 29 may discharge from the shroud into fuel tank 13. The flow area of this orifice 41 and the axial spacing between the deflector plate 36 and the ends of pipes 29 and 31 are correlated so that the apparatus delivers to outlet pipe 31 a controlled portion of the return flow whose size depends upon the rate of that flow. In particular these parts are so correlated that substantially all of the return fuel is delivered to pipe 31 at a predetermined low flow rate indicative of full throttle operation of engine 11, but only a selected portion of the returning fuel is delivered to pipe 31 at a predetermined higher flow rate indicative of engine idling. The balance of the returning fuel, of course, is directed into tank 13 via orifice 41. At other throttle positions, and consequently intermediate flow rates, the proportion of the returning fuel delivered to pipe 31 will lie between these limits and will increase and decrease in approximately inverse relation to the rate of flow. The return fuel must, of course, be supplemented by make-up fuel taken from tank 13 in order to satisfy the demand of pump 12. This make-up fuel is delivered to the mouth of pipe 31 through the flow path bounded by deflector plate 36 and the free ends of shroud sides 37 and 38. In this connection it is important to observe that the preferred mixing unit 24 inherently causes the warm return fuel which is directed to pipe 31 to sweep across the opening through which the make-up fuel enters shroud 34. This arrangement is advantageous because it effects melting of wax crystals in the region of that opening, and thus prevents it from being plugged.

The fuel pump 12 used on most railway locomotives has a capacity of 4.5 gallons per minute, or 270 gallons per hour. Engine 11, on the other hand, consumes only about 5 gallons per hour while idling, and only about 165 gallons per hour when operating at full load in the 8th, or highest, throttle setting. Therefore, in the typical system, the quantity of return fuel which enters mixing unit 24 through pipe 29 varies between 105 and 265 gallons per hour. Since the fuel system of a locomotive normally employs $\frac{3}{4}$ inch piping, this is the recommended size for the pipes 29 and 31 of unit 24. Thus, the velocity of the return fuel which issues from pipe 29 varies between a minimum of about 1 foot per second at full throttle and a maximum of about 3 feet per second at idle.

The design of the preferred mixing unit 24 is based on the representative values just mentioned and on two premises derived from experience with actual locomotives using the No. 2 fuel presently being furnished to the U.S. railroads. The first premise is that substantially the entire volume of the return flow available at full throttle should be delivered to the suction line 14 of pump 12 in order to preclude wax-up conditions anywhere in the fuel system when tank temperature is −30° F., which is considered to be the most extreme operating condition which will be encountered. The other premise is that trouble-free operation i.e., freedom from wax-up while avoiding overheating of the fuel under the same extreme cold condition, can be insured by delivering only about 60% of the return fuel to the suction line when the engine is idling. The performance of mixing unit 24 during full throttle operation is dependent mainly upon the axial spacing between deflector plate 36 and the mouths of pipes 29 and 31. This spacing is selected by taking into account the facts that the velocity of the return fuel is relatively low, that the return fuel stream tends to expand as it issues from pipe 29, and that shroud 34 encloses the space adjacent the pipe mouths sufficiently to guarantee that the suction applied to outlet pipe 31 by pump 12 will be effective to draw fuel from pipe 29 directly into pipe 31. The performance of unit 24 at idle conditions, on the other hand, is dependent mainly upon the ratio of the flow area of orifice 41 to the flow area of return pipe 29. However, the axial spacing between the deflector 36 and the pipe mouths must also be considered, since obviously the orifice will not be an effective flow splitter if the spacing is too large. Translating these conditions into design values, the dimensions labeled in FIG. 2 are calculated as follows:

$D_1 = \alpha\%\ D$ $D_2 = 40\%\ D$ $R = \frac{1}{2}(D + D_1)$ $L = 3D$, and preferably $= 2D$ Experience shows that the fuel system of FIG. 1 remains free of wax blockage at tank temperatures as low as −30° F., regardless of the throttle setting of engine 11. Moreover, it has been found that, at tank temperatures between −30° F. and 60° F., the temperature of the fuel delivered to primary filter 17 is in the range of 40°-100° F. In view of this, selector valve 21 requires resetting only twice a year i.e., in the fall when the tank temperature drops to 40° F. the valve is moved to the illustrated cold weather position, and in the spring when tank temperature rises to 40° F. the valve is moved to the hot weather position. This last mentioned manipulation isolates path 23 and the mixing unit from return line 19, and causes all of the excess fuel which by-passes injectors 16 to be delivered directly to tank 13 through pipe 22. In this mode of operation, the flow demands of pump 12 are satisfied exclusively by fuel which enters outlet pipe 31 from the tank, inasmuch as flow to return pipe 29 is interrupted. It obviously is not essential that the fall and spring switch-over be effected at the same temperatures, or that the switching temperature be 40° F. However, this is considered to be the safest and most convenient scheme for a railroad system such as the Union Pacific's, wherein a locomotive may encounter widely varying temperatures, sometimes high and sometimes low, in the course of a day. In this situation, switching at 40° F. is deemed to provide insurance against both wax blockages and overheating of the fuel oil.

The mixing unit 24 shown in FIGS. 2 and 3 is the preferred design because it is simple and reliable, relatively inexpensive, and easy to install. However, the unit 124 depicted in FIG. 4 is a close second choice. In fact, the only significant difference between these two units concerns the construction of the orifice through which return fuel is discharged into the fuel tank. In FIG. 4, that orifice 141 is defined by an opening through deflection plate 136, rather than by an edge of that plate and the bight 135 of shroud 134.

Figure 5:
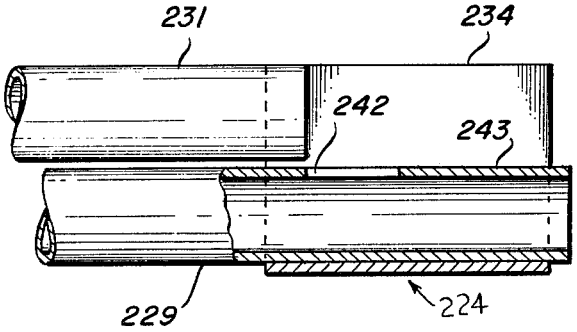

The mixing unit 224 shown in FIG. 5 also is an attractive alternative. In this design, the return pipe 229 is entended beyond the end of outlet pipe 231 and is provided with a transverse opening 242 which leads directly to the space immediately adjacent the mouth of the outlet pipe. This opening 242 defines the flow path through which return fuel is delivered to outlet pipe 231 under low flow (i.e., full throttle) conditions, so it has a relatively large cross sectional area which is governed by the same factors considered in selecting the axial spacing between deflector 36 and the pipe mouths in the FIG. 2 embodiment. The portion 243 of pipe 229 between opening 242 and the pipe mouth performs the same flow metering function as the orifices 41 and 141 in units 26 and 124, respectively. This throttling action can be controlled by proper selection of the length or the flow area of pipe portion 243, or by a combination of these two flow-restricting effects. Unit 224 is slightly more difficult to manufacture than units 24 and 124, because of the necessity for forming a side opening in pipe 229, but it is a practical design and affords the same good performance as those other mixing units.

Figure 6:
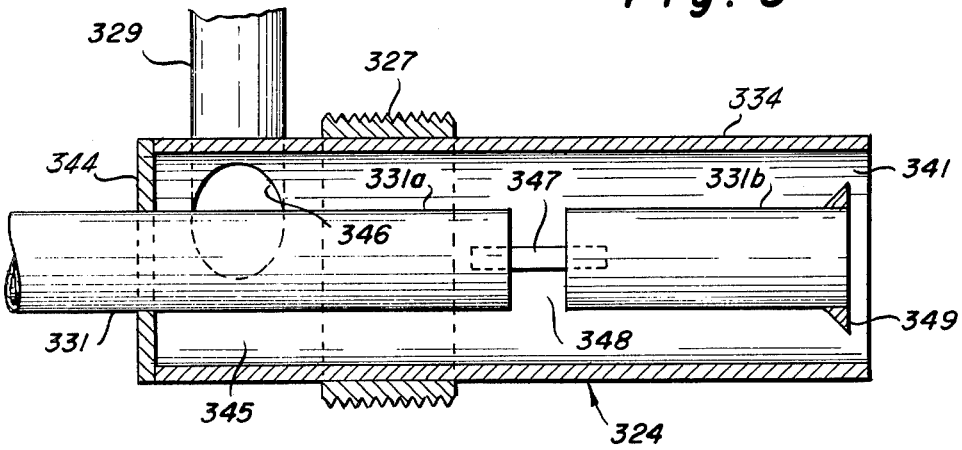

Another mixing unit 324, which uses a radically different construction, is illustrated in FIG. 6. This mixer 324 employs a cylindrical shroud 334 which extends through and is welded to the threaded sleeve 327 and has a closed outer end 344 through which passes the outlet pipe 331. Shroud 334 and pipe 331 are coaxial and bound an intervening annular space 345 which communicates tangentially with the return pipe 329 via a port 346 formed in the shroud near its closed end. Thus, the returning fuel is caused to follow a helical flow path as it moves through space 345 from port 346 to the open end of shroud 334. Outlet pipe 331 comprises two aligned, but axially spaced, sections **331*a* and 331*b* which are supported by a spider 347 and define a gap 348 through which the swirling return fuel may enter pipe section 331*a*. Gap 348 has a generous flow area determined by the same factors which influence the design of the port 242 in FIG. 5 and the axial spacing between the deflector and the pipe mouths in FIG. 2; therefore, at the low flow rate indicative of full throttle operation, essentially all of the return fuel delivered to space 345 is directed into the outlet pipe via gap 348. At lower throttle settings and higher flow rates, a portion of the return fuel is discharged from shroud 334 through the annular orifice 341 defined by the shroud and a throttling ring 349 fixed on pipe section 331*b*. As in the mixers of FIGS. 2 and 4, orifice 341 is sized to pass a selected portion, e.g., 40% of the return fuel which is available under idling conditions of the engine. The make-up fuel, which is needed to supplement the return fuel, enters pipe section 331*b* from the tank, then passes through the region of gap 348, where it joins the return fuel exiting through pipe section 331*a*. Although mixing unit 324 is relatively simple and inexpensive, it is not considered as reliable as the mixers described earlier because it does not cause the warm return fuel to sweep past the opening through which make-up fuel enters. As a result, there is a risk that this opening, which is defined by pipe section 331*b***, will become plugged by wax deposits at extremely low tank temperatures.

Figure 7:
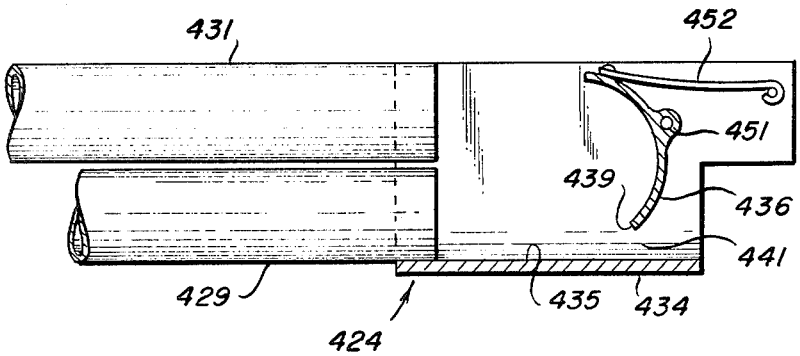

Although each of the mixing units described thus far is believed to afford adequate insurance against overheating of the fuel oil when switchover from the winter to the summer mode of operation is effected at about 40° F., a need for greater insurance can be satisfied by using the more refined unit 424 shown in FIG. 7. This unit is essentially the same as unit 24, except that here the deflector plate 436 is mounted for pivotal movement on an axle 451, which extends between the side walls of shroud 434, and that plate is positioned by a bimetal element 452 which is carried by the shroud and is located so as to respond to the temperature in the fuel tank. The arrangement is such that the bimetal element 452 pivots deflector 436 in the counter-clockwise direction, as viewed in FIG. 7, as tank temperature rises above a predetermined limit. As a result, the edge 439 of the deflector retreats from the bight 435 of shroud 434, thereby increasing the flow area of orifice 441 and causing a greater portion of the return fuel to be discharged into the fuel tank. This, of course, reduces the amount of return fuel included in the mixture supplied to the fuel pump, and thus keeps fuel temperature lower than in the case of the other mixers. Inasmuch as a bimetal element is a rugged temperature sensor, and adjustment of the position of deflector 436 is required only occasionally, the improved temperature-limiting capability of mixer 424 is obtained without an undue reduction in reliability.

It obviously is desirable, from the standpoint of economics, to provide a single design for the mixing unit which will accommodate the variations in the rate of flow of the return fuel which can be expected in the type of service for which the unit is intended. The principal variations, of course, are those attributable to differences between the capacities of the fuel pumps used in the systems. In the case of railway service, most fuel systems, as already mentioned, use a pump having a capacity of 4.5 gallons per minute. Mixers intended for this service are designed to handle the return flow rates associated with this particular size of pump, and consequently afford optimum performace when such a pump is employed. However, the mixing unit will give acceptable results even though it is used with a pump whose capacity is as low as 3.5 gallons per minute or as high as 7 gallons per minute. Since all of the fuel pumps used on the diesel locomotives of U.S. railroads have capacities within this range, it is evident that a single design of any of the mixing units described above can satisfy the needs of that industry. However, that mixing unit may not be acceptable for other users, such as the trucking industry, where a wider range of pump capacities is common. In that event, the mixing unit 524 depicted in FIG. 8 may be the most practical form of the invention.

Figure 8:
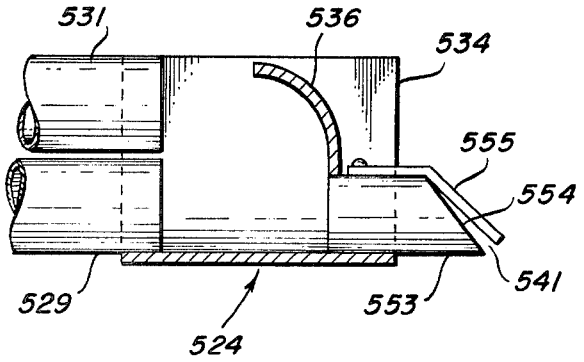

In contrast to the similar units shown in FIGS. 2 and 4, the mixer 524 uses a throttling device 541 whose restriction to flow decreases when there is a marked increase in the rate of flow of the return fuel. As shown in FIG. 8, the device 541 comprises a short pipe section 553 having an exit 554 which is partially obstructed by a leaf spring throttling element 555. The size of the flow path defined by exit 554 and element 555 determines the flow restriction afforded by device 541 and is set initially so that mixing unit 524 gives the desired flow-splitting result when it is used with pumps whose capacities are in the lower and middle portions of the expected range. Under these conditions, device 541 acts as a fixed restriction, so unit 524 operates in the same way as units 24 and 124. On the other hand, when unit 524 is used with a materially larger pump, the velocity of the return fuel will be correspondingly greater, and this fuel will deflect element 555 away from exit 554. This action effectively increases the flow area of throttling device 541 and thereby allows a greater proportion of the return fuel to be discharged into the fuel tank. As a result, the amount of return fuel directed into outlet pipe 531 is kept low enough to preclude overheating of the fuel.

Figure 9:
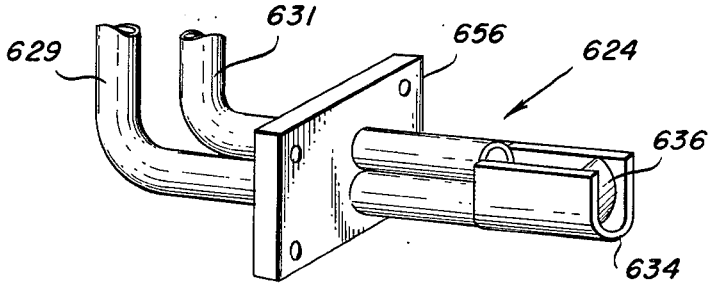
FIG. 9 is a perspective view of a mixing unit adapted for use on a GE locomotive.
Figure 10:
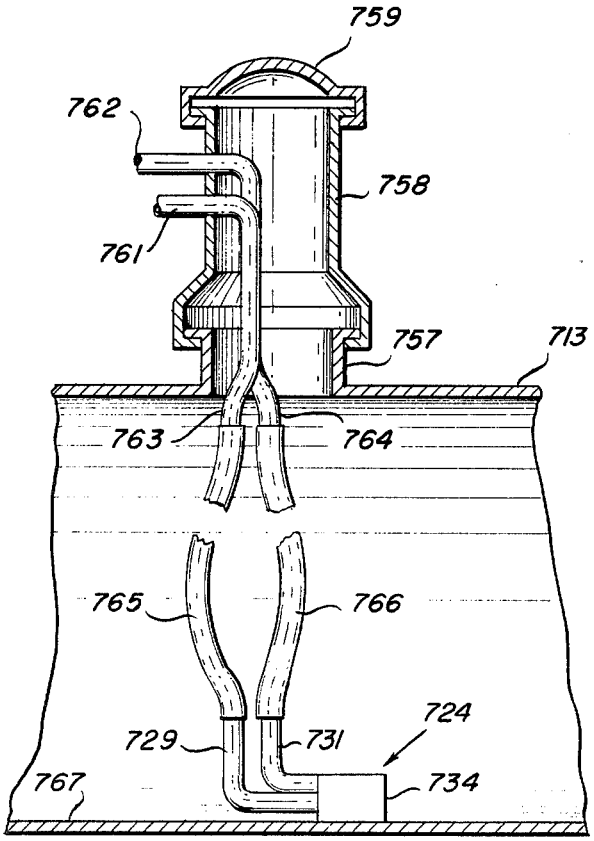
FIG. 10 is a sectional view showing the manner in which the mixing unit may be applied to the fuel tank of a truck.

In cases where the fuel tank does not have a tapped drain port large enough (i.e., about 2 inches) to accept the mixing unit, a mounting arrangement other than the one described above should be used. Two alternative arrangements are shown in FIGS. 9 and 10. The first of these embodiments is suitable for tanks, such as those used on General Electric locomotives, having a clean-out opening which normally is closed by a rectangular cover plate which is bolted to the tank. In this case, the mixing unit 624 includes a mounting plate 656 to which the return and outlet pipes 629 and 631 are welded, and which takes the place of the conventional cover plate when the unit is installed in the tank.

FIG. 10, on the other hand, illustrates a scheme for installing a mixing unit 724 through a fuel filler pipe 757 located in an upper region of tank 713. This arrangement includes a filler extension 758 which is formed to fit the existing filler pipe 757 and cap 759, and which is penetrated by rigid return and outlet conduits 761 and 762, respectively, which are welded in place. These conduits have depending portions 763 and 764 which are connected, respectively, with the return and outlet pipes 729 and 731 of mixing unit 724 by flexible hoses 765 and 766. The lengths of the hoses are selected to insure that unit 724 will lie on the bottom 767 of tank 713. Although this type of installation may be used on a locomotive, it seems more suitable for use by the trucking industry.

It will be noted that the return pipes of the mixing units shown in FIGS. 2, 4, 5, 7 and 8 are located below the outlet pipes. This particular orientation of the pipes is not essential, but it is preferred because it insures that the warm return fuel which discharges from the unit will contact and melt the wax crystals which accumulate in the bottom of the tank. However, if a different orientation is used, it is important that the position of the return pipe relative to the shroud remain unchanged, for the shroud must always serve to preclude free flow from the return pipe to the tank.

In the event it is not apparent, the reader should notice that corresponding parts in the various embodiments are designated by related numerals which are distinguished solely by the digit in the hundreds place.

I claim:

1. A fuel mixing unit useful when submerged in a stored body of fuel to combine fuel from that body with warmer fuel returning from a fuel injector to create a supply flow which is resistant to waxing, the unit comprising a. a return conduit for admitting said return flow and an outlet conduit for discharging said supply flow;

b. means defining a flow path leading from the outlet conduit to the exterior of the unit through which fuel in said body may flow to the outlet conduit; and c. flow dividing and directing means for delivering to the outlet conduit a controlled portion of the return flow admitted by the return conduit which depends upon the rate of that flow, the dividing and directing means being effective at a predetermined low flow rate to direct substantially the entire return flow to the outlet conduit, and being effective at a predetermined higher flow rate to direct only a selected portion of the return flow to the outlet conduit and to discharge the remainder of the return flow into the body in which the unit is submerged.

2. A fuel mixing unit as defined in claim 1 a. which includes a shroud in the form of a U-shaped channel; and b. said conduits have adjacent, parallel, open-ended portions which are partially enveloped by the shroud and which are so arranged that the return conduit admits said return flow along the bight of the shroud.

3. A fuel mixing unit as defined in claim 2 in which a. the flow dividing and directing means includes a deflector which is spaced axially from the open ends of the conduits and extends between the side walls of the U-shaped channel, b. the deflector being formed to provide a portion which intercepts and directs to the open end of the outlet conduit a portion of the flow stream which exits from the return conduit, and another portion which defines a control orifice through which the balance of that flow stream passes to the exterior of the unit, c. the axial spacing between the deflector and the one end of the return conduit being materially greater than the dimensions of the flow control orifice.

4. A fuel mixing unit as defined in claim 3 in which the deflector conprises a curved plate having an edge which is spaced from the bight of the channel to thereby define said control orifice.

5. A fuel mixing unit as defined in claim 3 in which the deflector comprises a curved plate containg an opening which has a cross section which is materially smaller than the cross section of the return conduit and which serves as said control orifice.

6. A fuel mixing unit as defined in claim 1 a. in which the flow dividing and directing means includes a flow control orifice through which said remainder of the return flow is discharged; and b. which includes means for varying the flow area of said orifice directly with the temperature of the unit.

7. The fuel mixing unit as defined in claim 4 in which a. the delector plate is mounted in the channel for pivotal movement about an axis normal to the side walls of the channel; and b. which includes a bimetal actuating strip reacting between the channel and the deflector plate and arranged to pivot that plate so as to increase the flow area of the control orifice as the temperature within the channel at the side of the plate remote from the conduits rises.

8. A fuel mixing unit as defined in claim 1 in which a. said conduits have adjacent, parallel, open-ended portions, and the outlet conduit terminates short of the end of the return conduit; and b. the flow dividing and directing means comprises first throttling means defined by a metering orifice in the wall of the return conduit located adjacent the end of the outlet conduit, and second throttling means located in the return conduit between the metering orifice and the end of the conduit.

9. A fuel mixing unit as defined in claim 8 in which the flow dividing and directing means also includes a shroud in the form of a U-shaped channel having a bight which receives the return conduit, and side walls which partially enclose a space at the open end of the outlet conduit.

10. A fuel mixing unit as defined in claim 1 a. which inclues a cylindrical shroud open at one end and having a wall closing the opposite end;

b. in which the outlet conduit enters the shroud through said end wall and extends axially of the shroud;

c. in which the return conduit communicates with the interior of the shroud through an opening in its cylindricial wall near the closed end and is arranged to direct fuel circumferentially of the shroud; and d. said flow dividing and directing means comprising first trottling means defined by a metering orifice in the wall of the outlet conduit, and second trottling means which restricts flow from the annular space between the outlet conduit and the shroud through the open end of the shroud.

11. A fuel mixing unit as defined in claim 10 in which the outlet conduit has two axially aligned, spaced portions, the spacing between said portions defining said metering orifice.

12. A fuel mixing unit as defined in claim 1 in which the flow dividing and directing means includes a throttling device through which said remainder of the return flow is discharged and whose restriction to flow decreases as the rate of return flow increases.

13. A fuel mixing unit as defined in claim 12 in which the throttling device comprises a. a third conduit having an entrance to which the return conduit directs return flow, and an exit which opens to the exterior of the unit; and b. a leaf spring member which overlies and obstructs said exit and is deflectable so as to decrease that obstruction by said flow of discharging return fuel.

14. In a fuel system for a diesel engine comprising a fuel tank, a pump connected to draw fuel from the tank through a suction line and deliver it to the engine at a rate which always exceeds the demands of the engine, and a return line through which excess fuel is discharged from the engine, the improvement which comprises a fuel mixing unit submerged in the fuel in said tank and arranged to supply to the pump warmed fuel which is resistant to waxing, the unit including a. a return conduit connected with said return line, and an outlet conduit connected with said suction line;

b. means defining a flow path through which fuel in the tank may enter the outlet conduit; and c. flow dividing and directing means for delivering to the outlet conduit a controlled portion of the return flow exiting from the return conduit which depends upon the rate of that flow, d. the dividing and directing means being effective at a low rate determined by the full throttle fuel demand of the engine to direct substantially the entire return flow to the outlet conduit, and being effective at a higher flow rate determined by idle flow demand of the engine to direct only a selected portion of the return flow to the outlet conduit and to discharge the remainder of the return flow into the tank.

15. A fuel system as defined in claim 14 including a heat exchanger interposed in the connection between the return conduit and the return line and which utilizes engine heat to heat the fuel delivered to the return conduit.

16. A fuel system as defined in claim 15 including a. a second return conduit which by-passes the mixing unit and leads into the tank; and b. a switching valve for connecting said return line with the first return conduit through the heat exchanger or connecting the return line with the second return conduit.

17. A fuel system as defined in claim 14 in which a. the fuel tank has a port which opens into its lower region; and b. the mixing unit is sized and shaped so as to be insertable into the tank through said port and includes a mounting member by which it is attached to the tank and which effectively closes said port.

18. A fuel system as defined in claim 17 in which a. said port is tapped; and b. said mounting member is a threaded sleeve which is screwed into said port.

19. A fuel system as defined in claim 17 in which said mounting member is a plate which covers said port and is bolted to the tank.

20. A fuel system as defined in claim 14 in which a. the fuel tank has a fuel filler pipe which opens into its upper region;

b. the mixing unit is sized and shaped so as to be insertable into the tank through the filler pipe; and c. which includes a filler pipe extension which is coupled to the filler pipe and is penetrated by rigid return and outlet pipes, and a pair of flexible hoses which join the return and outlet pipes to the return and outlet conduits, respectively, of the mixing unit and which are long enough to allow the mixing unit to lie on the bottom of the tank.

* * * * *